United States Patent [19]

Foran

[11] Patent Number: 4,792,795

[45] Date of Patent: Dec. 20, 1988

[54] ELECTRO-MECHANICAL LOCOMOTIVE BELL RINGING APPARATUS FOR QUICK AND EASY REPLACEMENT OF EXISTING PNEUMATIC BELL RINGING SYSTEMS

[76] Inventor: Roderick F. Foran, 202 Reade Street, Moncton, N.B., Canada, E1 C656

[21] Appl. No.: 935,530

[22] Filed: Nov. 26, 1986

Related U.S. Application Data

[63] Continuation-in-part of Ser. No. 729,948, May 2, 1985, abandoned.

[51] Int. Cl.[4] ..... G10K 1/063

[52] U.S. Cl. ..... 340/395; 116/150; 246/1 C; 340/392

[58] Field of Search ..... 340/384 E, 384 R, 392, 340/393, 395, 396; 116/148, 150, 152; 246/217, 220, 1 R, 1 C; 335/131, 126, 105, 133

[56] References Cited

U.S. PATENT DOCUMENTS

| | | | |
|---|---|---|---|
| 802,675 | 10/1905 | Avery | 340/395 |
| 1,256,262 | 2/1918 | Roeder | 340/395 |
| 2,271,084 | 1/1942 | Lasowsky | 340/395 |
| 2,546,389 | 3/1951 | Damast | 340/395 |
| 2,663,013 | 12/1953 | Bronson | 340/395 |
| 4,706,037 | 11/1987 | Prouty et al. | 335/131 |

*Primary Examiner*—Joseph A. Orsino
*Assistant Examiner*—Brent A. Swarthout
*Attorney, Agent, or Firm*—Donald A. Kettlestrings

[57] ABSTRACT

An electro-mechanically operated locomotive bell ringing apparatus designed to quickly and easily replace existing air operated bell ringing systems. The bell ringing apparatus is mounted within the bell and the existing bell striker is attached to the apparatus. Closing of a switch mounted on the engineman's console activates a timer which energizes a coil within the apparatus in a predetermined manner to cause the striker to move against the bell.

10 Claims, 3 Drawing Sheets

ELECTRO-MECHANICAL LOCOMOTIVE BELL RINGING APPARATUS FOR QUICK AND EASY REPLACEMENT OF EXISTING PNEUMATIC BELL RINGING SYSTEMS

This application is a continuation-in-part of application Ser. No. 729,948 filed May 2, 1985, for Locomotive Bell Ringing Apparatus and now abandoned.

BACKGROUND OF THE INVENTION

This invention relates to bell ringing apparatus and more particularly to electromechanically operated bell ringing apparatus for enabling the quick and easy replacement of existing pneumatic bell ringing systems.

All railroads in the United States and Canada now use compressed air to operate locomotive bell ringers, but pneumatically operated locomotive bell ringers have disadvantages which often interfere with reliable operation of the bell ringers.

For example, air stored under pressure in reservoirs heats up, and when the air cools water condensate forms. Oil is also frequently present in the air system because of leakage past worn piston rings from the crank case of the air compressor. The mixture of oil and water within the pneumatic system causes a sludge to form which can block the finely machined orifices in the pneumatic system. This blockage can result in failure of the bell ringing system. The presence of water in the air system of existing bell ringing systems also causes those systems to freeze in cold temperatures. Maintenance costs are high with pneumatically operated bell ringing systems, and costly train delays are sometimes the result of the unpredictable failures of the presently used systems.

It is, therefore, an object of the present invention to provide a reliable, electromechanically operated bell ringing apparatus for use with locomotive bells.

Another object is to provide a completely weatherproof, electromechanical bell ringing apparatus.

A further object of the invention is the provision of such an apparatus which uses a minimum of components and which operates with reduced maintenance costs.

Still another object is to provide such an apparatus which operates the bell striker with sufficient force to provide for the necessary decibel rating.

A still further object is to provide such an apparatus which is designed to easily and quickly replace existing pneumatic bell ringing systems.

Still another object is to provide such an apparatus in which the working parts are protected from snow, water and dirt.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects the present invention provides bell ringing apparatus for use with a railway locomotive bell and striker, the apparatus comprising: a housing defining a first opening therein; means in operative relationship with the housing for attaching the housing to the bell; means attached to the housing adjacent to the first opening for rotatably supporting the striker with a predetermined portion of the striker positioned beneath the first opening; a first ferromagnetic core member supported by the housing and defining a substantially axially aligned bore extending through the entire length of the core and in alignment with the first opening; an electrical coil supported by the housing and defining a substantially axially aligned central opening receiving the first core therein; a second ferromagnetic core member positioned within the central opening, the second core member of predetermined length to extend above an upper boundary of the central opening when the second core member rests on the first core member; an inverted U-shaped ferromagnetic armature supported by the second core member, the armature defining a substantially horizontal member having opposed ends and further defining first and second substantially vertical members extending downwardly from the opposed ends, respectively, and adjacent to the exterior of the coil; a rod member projecting downwardly from the second core member, through the bore and through the first opening for contacting the predetermining portion of the striker; and means in operative relationship with the coil for selectively energizing and de-energizing the coil in a predetermined manner whereby the striker is moved to sound the bell by movement of the rod member against the striker. It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate an example of a preferred embodiment of the invention and, together with the description, serve to explain the principles of the invention.

DESCRIPTION OF THE PREFERRED EMBODIMENT

Figure 1:
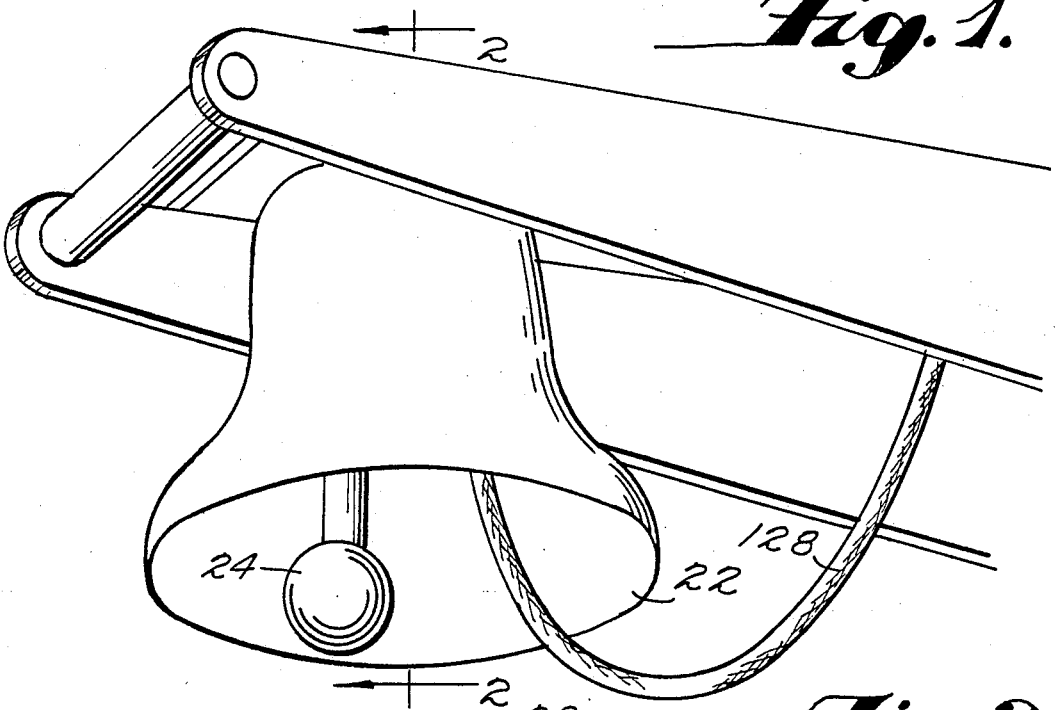
FIG. 1 is a perspective view of a locomotive bell mounted on a locomotive.
Figure 2:
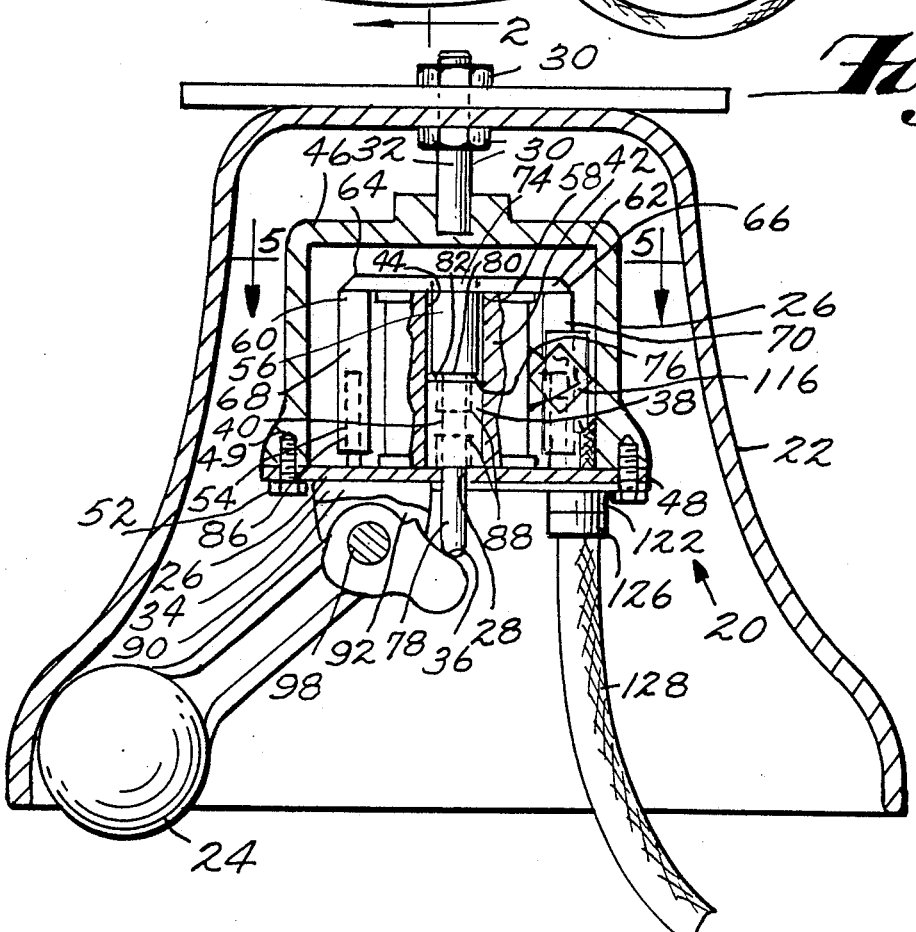
FIG. 2 is a partial cross-sectional view of the bell in FIG. 1 taken substantially along the line 2—2 in FIG. 1 looking in the direction of the arrows and showing the striker as it strikes the bell.

With reference now to the drawings, wherein like reference characters designate like or corresponding parts throughout the several views, there is shown a bell ringing apparatus 20 in accordance with this invention. Apparatus 20 is shown in FIG. 2 in its operative position mounted within bell 22 and with bell striker 24 attached to apparatus 20.

Apparatus 20 includes a housing 26 defining a first opening 28 therein. Means 30 are provided in operative relationship with housing 26 for attaching the housing to bell 22. Attaching means 30 preferably comprise a mounting stud 32, which in the preferred embodiment is a class 5 steel bolt seven eighths by five inches with a standard thread.

Means 34 are attached to housing 26 adjacent to opening 28 for rotatably supporting striker 24 with a predetermined portion 36 of the striker positioned beneath opening 28. A first ferromagnetic core member 38 is supported by housing 26 and defines a substantially axially aligned bore 40 extending through the entire length of core member 38 and in alignment with opening 28. An electrical coil 42 is supported by housing 26 and defines a substantially axially aligned central opening 44 which receives core member 38 therein.

Housing 26 includes an upper, dome-shaped, non-magnetic housing element 46 and a lower, substantially flat housing element 48. Upper housing element 46 is preferably made of aluminum, and lower housing element 48 is preferably made of cast iron. Housing element 46 is attached to lower housing element 48 by four class five steel studs 49 and four self-locking nuts 52. Lower housing element 48 supports coil 42 and a guide pin 54, and core member 38 is preferably cast integral with lower housing element 48.

During assembly, coil 42 is mounted over core member 38 and several ounces of silicone sealant (not shown) are applied to lower housing element 48 at the outer circumference of coil 42 prior to mounting, and the coil is imbedded in this sealant. The sealant, which has good dielectric properties, also forms an excellent bond between coil 42 and lower housing element 48, and the sealant retains a high degree of elasticity. The sealant preferred is Locktite Super Flex made by Locktite Missisauga of Ontario, Canada, but the sealant is also available from a number of other manufacturers. The sealant is also used to form a weather-tight gasket between upper housing element 46 and lower housing element 48 at the time of assembly.

A second ferromagnetic core member 56 is positioned within central opening 44, and core member 56 is of a predetermined length to extend slightly above an upper boundary 58 of central opening 44 when core member 56 rests on core member 38, (see FIG. 2).

An inverted, U-shaped, ferromagnetic armature 60 is supported by core member 56. Armature 60 includes a substantially horizontal member 62 having opposed ends 64, 66, and armature 60 further includes first and second substantially vertical members 68, 70 extending downwardly from opposed ends 64, 66 respectively, and positioned adjacent to the exterior 72 of coil 42.

Armature 60 is preferably comprised of mild steel, and horizontal member 62 is preferably fillet welded to vertical armature members 68, 70. Horizontal armature member 62 is much thinner than the two vertical members 68, 70. For example, the thickness of horizontal armature member 62 is preferably 0.1875 inch while the thickness of each of vertical armature members 68, 70 is preferably 0.375 inch. Horizontal armature member 62 is substantially one half the thickness of vertical armature members 68, 70 to permit the maximum amount of vertical travel for armature 60 within housing 26. Vertical armature members 68, 70 add desired mass to armature 60, and because they are located within the magnetic flux generated by coil 42 they maximize the downward velocity of armature 60 when coil 42 is energized. This maximized armature velocity translates into maximized force of rod member 78 against portion 36 of striker 24 and provides for a maximized decibel rating when striker 24 hits bell 22.

Centrally located within horizontal armature member 62 is a hole 74 to which core member 56 is fillet welded. The opposite end 76 of core member 56 is centrally bored and tapped to receive a rod member 78. Rod member 78 projects downwardly from core member 56, through bore 40 and through opening 28 for contacting predetermined portion 36 of striker 24.

A non-magnetic washer, 80, preferably made of bronze or other non-magnetic material such as nylon or fiberglass, is pressed over rod member 78 at time of assembly. Washer 80 is positioned around the rod member and is held against a lower surface 76 of core member 56. When armature 60 is at the bottom of its downward stroke (see FIG. 2), washer 80 contacts upper surface 82 of core member 38 to limit the downward movement of core member 56 and of armature 60. Washer 80 also prevents magnetic retentivity from causing erratic bell operation due to momentary attraction between core members 38 and 56, and washer 80 also maintains a predetermined clearance (preferably 0.050 inch) between horizontal armature member 62 and coil 42 when armature 60 is at the limit of its downward stroke, as shown in FIG. 2.

Figure 7:
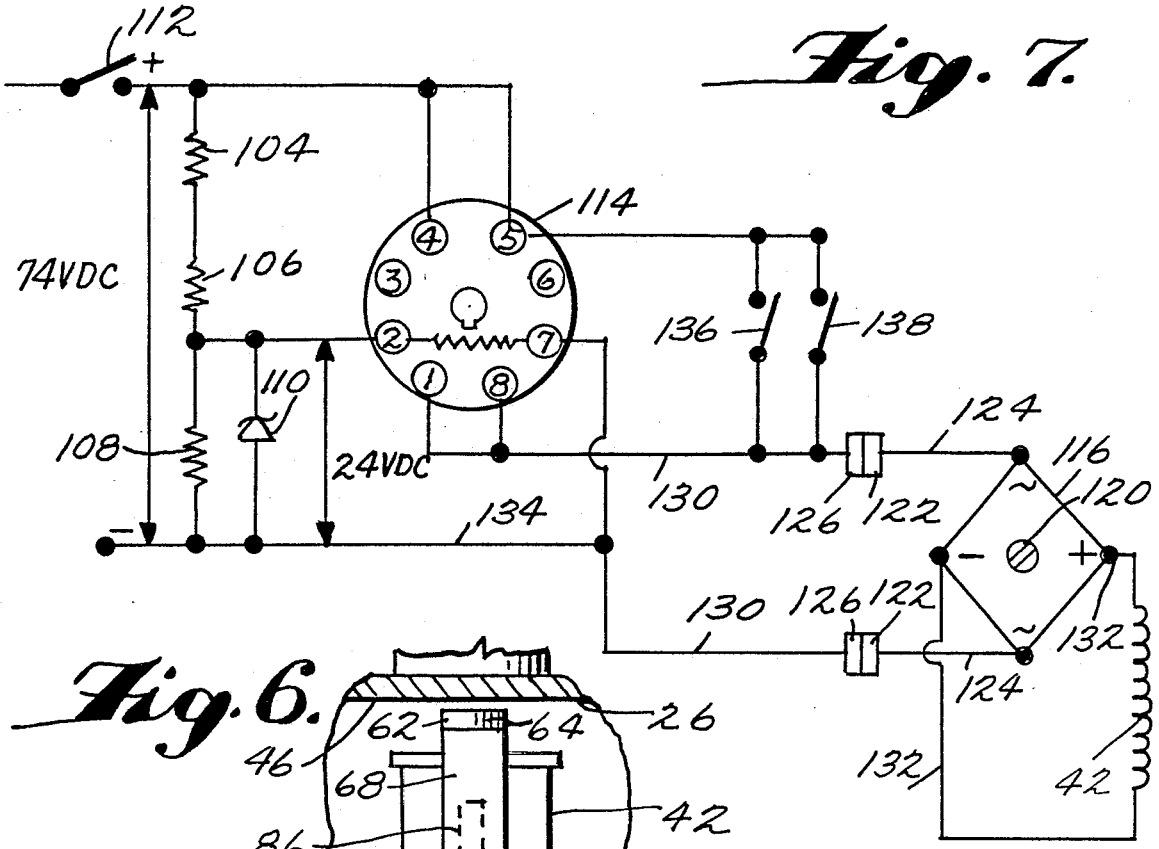
FIG. 7 is a circuit diagram of the electronic elements of the invention.
Figure 6:
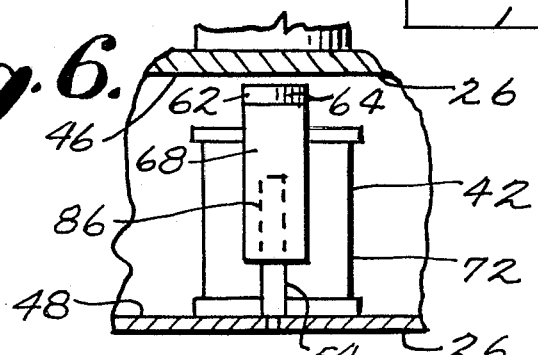
FIG. 6 is a partial cross-sectional view taken along the line 6—6 in FIG. 3 and looking in the direction of the arrows.

A non-magnetic guide pin 54 is supported by lower housing element 48 of housing 26, and vertical armature member 68 defines a vertical bore 86 therein for slideably receiving guide pin 54 so that rotation of armature 60 is prevented. Guide pin 54 is preferably made of bronze, measures one and one quarter inch long by one quarter inch in diameter and is threaded into lower housing element 48. Prevention of rotation of armature 60 is important to avoid contact by the armature with supply wires 124 or coil wires 132 (FIG. 7).

Figure 4:
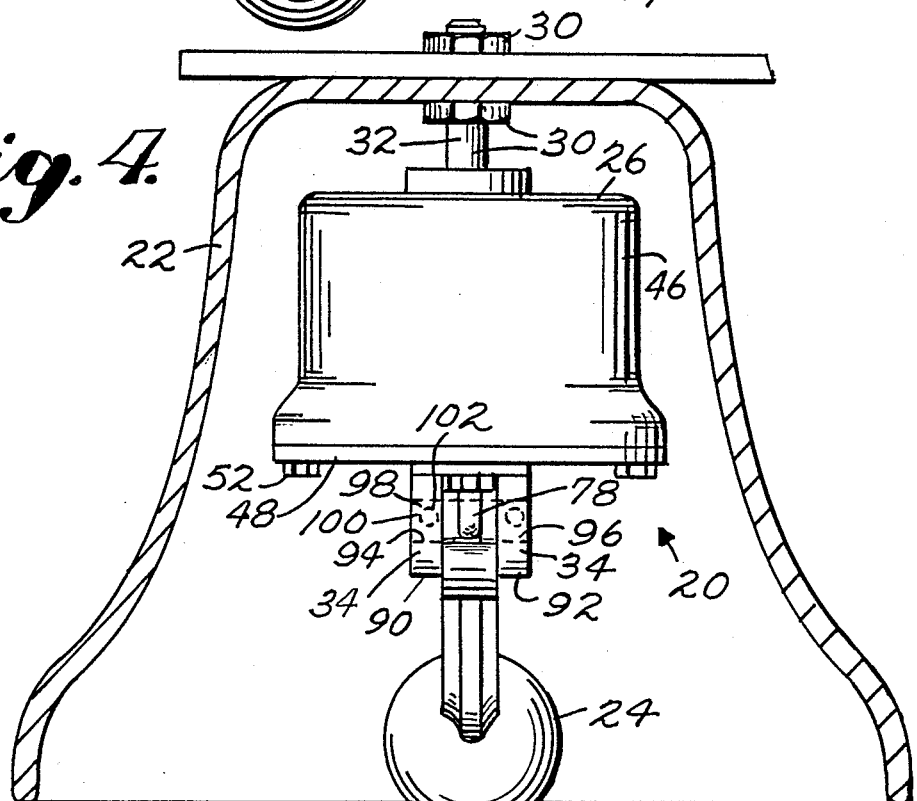
FIG. 4 is a partial cross-sectional view taken substantially along the line 4—4 in FIG. 3 and looking in the direction of the arrows.
Figure 5:
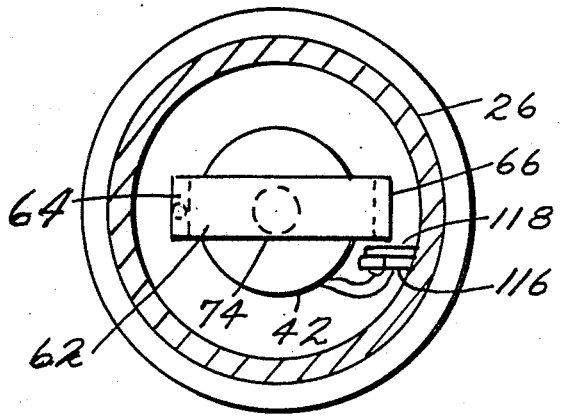
FIG. 5 is a partial cross-sectional view taken along the line 5—5 in FIG. 2 and looking in the direction of the arrows.

Two Oilite bushings 88 are positioned within bore 40 to form a self-lubricating passage for rod member 78. Striker supporting means 34 include two opposed and substantially parallel supports 90, 92 which extend downwardly from and beneath housing 26. Striker supports 90, 92 are preferably cast integral with lower housing element 48, and each of supports 90, 92 defines a bore 94, 96, respectively, (see FIG. 4) for receiving a striker fulcrum pin 98. Striker fulcrum pin 98 is transferred from the existing pneumatic bell ringing system to the system of this invention at the time the pneumatic system is replaced, and bores 94, 96 are sized to receive a standard three quarter inch by one and one-half inch striker fulcrum pin.

Striker support 90 further defines a set screw bore 100 (see FIGS. 3 and 4) in communication with bore 94, and a set screw 102 is threadedly positioned within bore 100 for contacting fulcrum pin 98 and for preventing relative motion and wear between fulcrum pin 98 and supports 90, 92.

Means are also provided in operative relationship with coil 42 for selectively energizing and de-energizing the coil in a predetermined manner whereby striker 24 is moved to sound bell 22 by movement of rod member 78 against the striker. The energizing and de-energizing means include a source of DC voltage (see FIG. 7). Nominal control voltage on all diesel-electric locomotives built in the United States and Canada is seventy four volts DC with the diesel engine running. The apparatus described herein is designed to operate on seventy four volts DC. A voltage divider network consisting of resistors 104, 106 and 108 in combination with zener diode 110 are connected in circuit relationship with the DC voltage source by means of normally open single-pole, single-throw switch 112. Switch 112 is located on the engineman's console and is in circuit between the DC voltage source and the voltage divider network.

A timer 114 is provided in circuit with the DC voltage source, switch 112 and the voltage divider network; and a full wave rectifier 116 is provided in circuit between timer 114, the DC voltage source, and coil 42 for providing the DC voltage to coil 42 as determined by timer 114.

Timer 114 is adjustable to control the time period during which the DC voltage is supplied to rectifier 116 and coil 42 and to control the time period during which the DC voltage is not supplied to rectifier 116 and to coil 42. Timer 114 can be any one of a number of commercially available units, and the timer has two adjustable dials, one adjusted to give the proper "on" time and the other to adjust the proper "off" time. One example of a conventional timer 114 is Omron H3BF-8 made by Omron Canada Inc. The Omron timer is supplied by a twenty four volt DC zener regulated supply voltage, and the mechanical service life for the Omron timer is twenty $\times 10^6$ operations.

Figure 3:
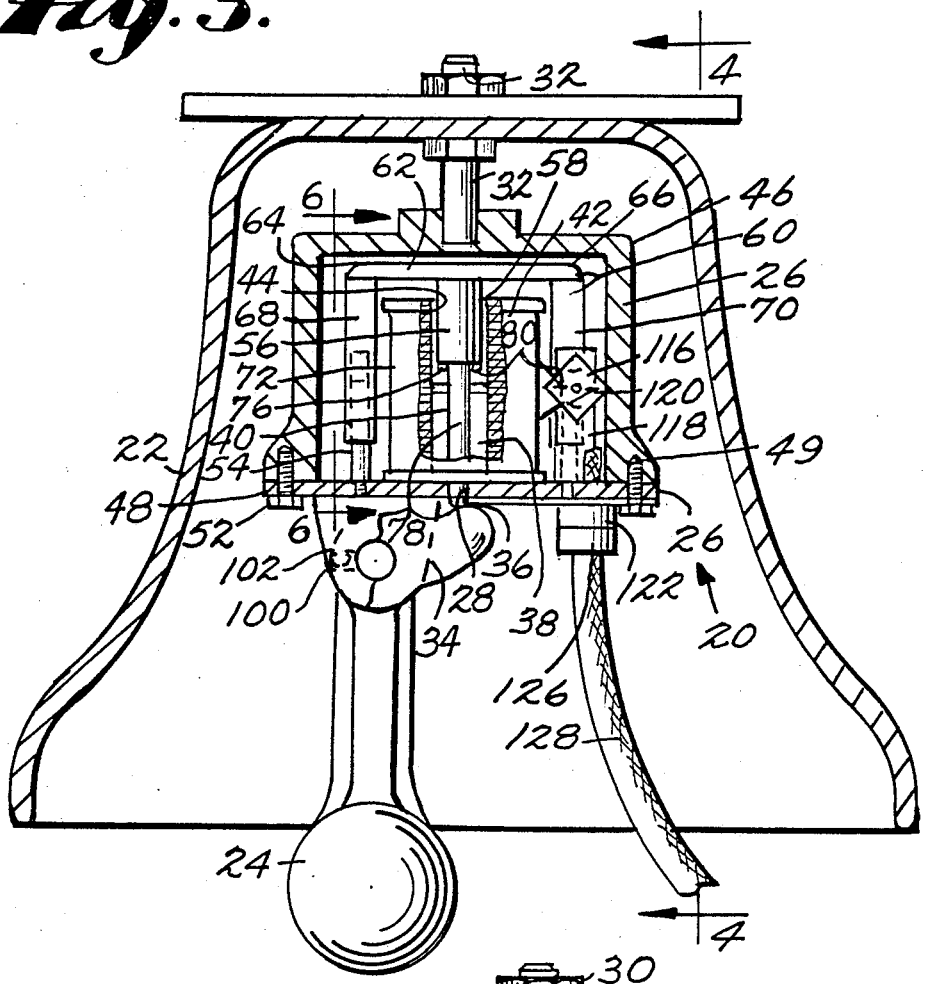
FIG. 3 is a partial cross-sectional view of the bell in FIG. 1 taken substantially along the line 2—2 in FIG. 1 looking in the direction of the arrows and showing the striker in its normal, at rest position.

Rectifier 116 is preferably located within housing 26, as illustrated in FIGS. 2 and 3. If rectifier 116 were at a remote location, the individual negative wire would have to be located at the main negative bus, a practice which would make installation cost appreciably higher. Rectifier 116 is preferably a three ampere 600 P.I.V. full wave rectifier. The purpose of the full wave rectifier is to supress spike voltages generated by coil 42 and to render it impossible to connect to the DC voltage supply with reverse polarity. A free-wheeling diode, if used in place of full wave rectifier 116, would control spike voltages but would be destroyed if inadvertently connected with the wrong polarity, and damage could result to the control circuitry.

Rectifier module 116 is mounted on a bracket 118 within housing 26. Bracket 118 is bolted or otherwise connected to lower housing element 48, and a vertical piece of fiberglass epoxy insulating material (not shown) is attached to bracket 118. Rectifier module 116, in turn, is secured to the insulating material using a brass bolt 120.

A two pin Amphenol connecter Amp. 56307-8 or similar type connecter is used so that the connecter can be uncoupled quickly for servicing as required. A male half 122 of the connecter is attached to lower housing element 48, and two short supply wires 124 (FIG. 7) connect male half of connecter 122 to the input terminals of rectifier module 116. The female half 126 of the connecter is fitted to supply cable 128, and supply cable 128 is typically a two conducter 16 A.W.G. type SO Cabtire cable. Supply wires 130 are connected to the female half of connecter 126, and from the female half of connecter 126 supply wires 130 are led into the locomotive cab where they are connected to timer 114, which in turn, is controlled by switch 112 located on the engineman's control panel (not shown). The wires of coil 42 are connected to the output terminals of rectifier 116. Coil 42 is preferably totally encapsulated, and the coil has a resistance of sixty eight to seventy four ohms at seventy degrees F. and current draw steady state averages one ampere.

In operation of the bell ringing apparatus, the apparatus and striker 24 are initially in the positions shown in FIG. 3. Bell ringing is initiated by the engineman closing switch 112, which is located on the engineman's control panel in the cab of the locomotive. Switch 112 is fed with a positive seventy four volts DC from a control voltage supply (not shown) on the locomotive.

Upon closure of switch 112, a positive seventy four volts DC is fed to timer 114. A common negative wire 134 is connected to timer 114. Standard railway practice is to switch and control the positive wire and to connect the negative wire directly from the main negative bus to the various circuit components.

Timer 114 is fed a stable twenty four volts DC through the voltage divider network consisting of resisters 104, 106, 108 in combination with zener diode 110. A positive twenty four volts DC is fed to terminal two of timer 114, and a negative voltage is fed to terminal seven of the timer, as shown in FIG. 7.

A relay (not shown) associated with conventional timer 114 will open and close its contacts 136, 138 in response to the timing set on the adjusting dials (not shown) of timer 114. Nominally the setting has been found to be 0.25 second "on" and 0.20 second "off" to obtain optimum effect and maximum decibels as striker 24 hits bell 22. Closing of relay contacts 136, 138 will send a positive seventy four volts DC pulse through supply wires 130, 124 and through connecters 126, 122 to one of the input terminals of full-wave rectifier 116. The other input terminal of rectifier 116 is connected to common negative bus 134. Current flows through rectifier 116, and the DC output voltage is supplied to coil 42. Thus, coil 42 receives a seventy four volts DC pulse for a time period and at a frequency controlled by timer 114.

When the engineman closes switch 112, coil 42 is energized and de-energized, as previously explained, as controlled by timer 114. As long as switch 112 is closed, coil 42 will continue to be energized and de-energized. When coil 42 is energized, core member 56 and armature 60 will be drawn downwardly toward core 38. Rod member 78 will simultaneously be moved in a downward direction against predetermined portion 36 of striker 24. A clearance between central opening 44 and core member 56 allows for free vertical movement of core member 56 and rod member 78. The size and positions of vertical armature members 68, 70 adjacent to coil 42 maximize use ofthe flux generated by coil 42 to cause downward movement of rod member 78 with maximum force against predetermined portion 36 of striker 24.

The force of rod member 78 against portion 36 of striker 24 causes the striker to swing in an arc about striker fulcrum pin 98, and the striker contacts the inner face of bell 22 (see FIG. 2). Oilite bushings 88 allow for free vertical movement of rod member 78 within bore 40.

When armature 60 reaches the limit of its downward travel, washer 80 contacts upper surface 82 of core member 38. When timer 114 is properly adjusted, the electrical pulse to coil 42 is interrupted when or just before armature 60 reaches the limit of its downward movement, and striker 24 then falls back to a vertical position. Rod member 78 and armature 60 are forced in an upward direction to the limit of their upward travel, as shown in FIG. 3. If timer 114 is properly adjusted, coil 42 should receive another pulse as armature 60 reaches the limit of its upward travel, and the action is repeated as long as switch 112 is closed.

Among the advantages provided by the bell ringing apparatus herein described is that the decibel rating achieved equals or exceeds the decibel rating of air-operated bells.

Nominal control voltage on all diesel-electric locomotives built in the United States and Canada is seventy-four volts DC with the diesel engine running. A thirty-two cell sixty four volt wet cell battery typically supplies auxilliaries with the engine at rest. The bell ringing apparatus of this invention will operate on sixty-four volts DC but its decibel rating is proportionally greater with the locomotive engine running, and the apparatus is designed to optimally operate on seventy four volts DC.

The bell ringing apparatus herein described will accept the striker and fulcrum pin from air-operated ringers now in use. These components, if in serviceable condition, can be transferred from an existing air-operated system to the apparatus of the invention at the time the apparatus is placed on the locomotive.

This invention provides a bell ringing apparatus which is simple in construction and which uses a minimum number of components. The apparatus described herein is of limited size so that no part of apparatus housing 26 is in contact with the interior of bell 22. This is necessary to maintain the resonance of the bell. Because of the limits in size of housing 26, coil 42 is designed to obtain the maximum number of ampere-turns (four thousand) while allowing space inside the housing for the other components.

The decibel rating of the apparatus described herein is equal to or exceeds the decibel rating of air-operated bells. The design of armature 60 makes maximum use of the flux generated by coil 42 while also permitting maximum vertical movement of the armature. Housing 26 also protects the working parts of the apparatus from the intrusion of snow, water, and dirt encountered in normal usage.

The invention in its broader aspects is not limited to the specific details shown and described, and departures may be made from such details without departing from the principles of the invention and without sacrificing its chief advantages.

What is claimed is:

1. Bell ringing apparatus for use with a railway locomotive bell and striker, said apparatus comprising:

a housing defining a first opening therein;

means in operative relationship with said housing for attaching said housing to said bell:

means attached to said housing adjacent to said first opening for rotatably supporting said striker with a predetermined portion of said striker positioned beneath said first opening;

a first ferromagnetic core member supported by said housing and defining a substantially axially aligned bore extending through the entire length of said core member and in alignment with said first opening:

an electrical coil supported by said housing and defining a substantially axially aligned central opening receiving said first core member therein;

a second ferromagnetic core member positioned within said central opening, said second core member of predetermined length to extend above an upper boundary of said central opening when said second core member contacts said first core member;

an inverted U-shaped ferromagnetic armature supported by said second core member, said armature defining a substantially horizontal member having opposed ends and further defining first and second substantially vertical members extending downwardly from said opposed ends, respectively, and adjacent to the exterior of said coil;

a rod member projecting downwardly from said second core member, through said bore and through said first opening for contacting said predetermined portion of said striker; and means in operative relationship with said coil for selectively energizing and de-energizing said coil in a predetermined manner whereby said striker is moved to sound said bell by movement of said rod member against the striker.

2. Apparatus as in claim 1 further including a non-magnetic washer positioned around said rod member and held against a lower surface of said second core member, whereby said washer contacts an upper surface of said first core member to limit downward movement of said second core member and said armature.

3. Apparatus as in claim 2 wherein said horizontal armature member is of a predetermined thickness and wherein said vertical armature members are each of a thickness substantially twice as great as said predetermined thickness.

4. Apparatus as in claim 3 further including a non-magnetic guide pin supported by said housing and wherein a first one of said vertical armature members defines a vertical bore therein for slideably receiving said guide pin, whereby rotation of said armature is prevented.

5. Apparatus as in claim 4 wherein said striker supporting means include two opposed and substantially parallel supports extending downwardly from and beneath said housing, said supports each defining a bore for receiving a striker fulcrum pin.

6. Apparatus as in claim 5 wherein a first one of said supports further defines a set screw bore in communication with said striker fulcrum receiving bore of said first support and further including a set screw threadedly positioned within said set screw bore and contacting said fulcrum pin and preventing relative motion for wear between said fulcrum pin and said supports.

7. Apparatus as in claim 6 wherein said housing includes an upper, dome-shaped, non-magnetic housing element, and a lower, substantially flat housing element connected to said upper housing element, said lower housing element supporting said coil, said first core member and said guide pin.

8. Apparatus as in claim 7 wherein said supports extend downwardly from and beneath said lower housing element.

9. Apparatus as in claims 1 or 8 wherein said energizing and de-energizing means include:

a source of D.C voltage;

a voltage divider in circuit relationship with said voltage source;

a normally open switch in circuit between said voltage source and said voltage divider;

a timer in circuit with said voltage source, said switch and said voltage divider; and a full wave rectifier in circuit between said timer, said voltage source and said coil for providing said D.C. voltage to said coil as determined by said timer.

10. Apparatus as in claim 9 wherein said timer is adjustable to control the time period during which said D.C. voltage is supplied to said rectifier and to said coil, and to control the time period during which said D.C. voltage is not supplied to said rectifier and to said coil.

* * * * *

UNITED STATES PATENT AND TRADEMARK OFFICE

CERTIFICATE OF CORRECTION

PATENT NO. : 4,792,795

DATED : December 20, 1988

INVENTOR(S) : Roderick F. Foran

It is certified that error appears in the above-identified patent and that said Letters Patent is hereby corrected as shown below:

Col. 8, Claim 6, line 6, delete "and" and substitute --for--.

line 6, delete "for" and substitute --and--.

Signed and Sealed this

Twenty-fifth Day of July, 1989

*Attest:*

DONALD J. QUIGG

*Attesting Officer*

*Commissioner of Patents and Trademarks*